US007609841B2

(12) United States Patent
Freed et al.

(10) Patent No.: US 7,609,841 B2
(45) Date of Patent: Oct. 27, 2009

(54) FREQUENCY SHIFTER FOR USE IN ADAPTIVE FEEDBACK CANCELLERS FOR HEARING AIDS

(75) Inventors: Daniel J. Freed, Santa Monica, CA (US); Sigfrid D. Soli, Sierra Madre, CA (US)

(73) Assignee: House Ear Institute, Los Angeles, CA (US)

( * ) Notice: Subject to any disclaimer, the term of this patent is extended or adjusted under 35 U.S.C. 154(b) by 594 days.

(21) Appl. No.: 10/912,690

(22) Filed: Aug. 4, 2004

(65) Prior Publication Data

US 2005/0271222 A1 Dec. 8, 2005

Related U.S. Application Data

(60) Provisional application No. 60/492,786, filed on Aug. 4, 2003.

(51) Int. Cl.
*H04R 25/00* (2006.01)

(52) U.S. Cl. ..... 381/318; 381/94.2; 381/98; 381/93

(58) Field of Classification Search ..... 381/93, 381/318, 83, 95, 96, 94.2, 94.3, 98; 700/94
See application file for complete search history.

(56) References Cited

U.S. PATENT DOCUMENTS 5,541,867 A * 7/1996 Corry et al. ..... 708/322
5,748,751 A 5/1998 Janse et al.
6,175,631 B1 1/2001 Davis et al.
2003/0026437 A1 2/2003 Janse et al.

OTHER PUBLICATIONS

Chi H-F, Gao SX, Soli SD, Alwan A (2003). Band-limited feedback cancellation with a modified filtered-X LMS algorithm for hearing aids. *Speech Communication*, 39:147-161.
Dolson M (1986). The phase vocoder: a tutorial. *Computer Music Journal*, 10(4):14-27.
Hellgren J, Forssell U (2001). Bias of feedback cancellation algorithms in hearing aids based on direct closed loop identification. *IEEE Transactions on Speech and Audio Processing*, 9(7):906-913.
Joson HAL, Asano F, Suzuki Y, Sone T (1993). Adaptive feedback cancellation with frequency compression for hearing aids. *Journal of the Acoustical Society of America*, 94(6):3248-3254.
Kates JM (1999). Constrained adaptation for feedback cancellation in hearing aids. *Journal of the Acoustical Society of America*, 106(2):1010-1019.
Laroche J, Dolson M (1999). Improved phase vocoder time-scale modification of audio. *IEEE Transactions on Speech and Audio Processing*, 7(3):323-332.

(Continued)

*Primary Examiner*—Vivian Chin
*Assistant Examiner*—Jason R Kurr
(74) *Attorney, Agent, or Firm*—Blakely, Sokoloff, Taylor & Zafman LLP

(57) ABSTRACT

A decorrelation method for improving feedback cancellation utilizes a small frequency shifting ratio, on the order of 0.3 percent. Frequency shifting is applied only to the high frequency portion of the signal, which is shifted alternately upward and downward.

8 Claims, 2 Drawing Sheets

OTHER PUBLICATIONS

Lee FF (1972). Time compression and expansion of speech by the sampling method. *Journal of the Audio Engineering Society*, 20(9):738-742.
Siqueira MG, Alwan A (2000). Steady-state analysis of continuous adaptation in acoustic feedback reduction systems for hearing-aids. *IEEE Transactions on Speech and Audio Processing*, 8(4):443-453.
Smith JO, Friedlander B (1985). Adaptive interpolated time-delay estimation. *IEEE Transactions on Aerospace and Electronic Systems*, AES-21(2):180-199.
Yost WA, Nielsen DW (1985). *Fundamentals of Hearing: An Introduction*, 2nd ed., Holt, Rinehart and Winston, Chapter 12, pp. 151-161.

* cited by examiner

FREQUENCY SHIFTER FOR USE IN ADAPTIVE FEEDBACK CANCELLERS FOR HEARING AIDS

RELATED APPLICATION

This application claims the benefit of provisional application Ser. No. 60/492,786 filed on Aug. 4, 2003.

GOVERNMENT RIGHTS

This invention was made with U.S. Government support under grant no. R01 DC 03825 awarded by the National Institute on Deafness and Other Communication Disorders (NIDCD). The U.S. Government has certain rights in the invention.

BACKGROUND OF THE INVENTION

1. Field of the Invention

This invention relates to the field of hearing aids. More particularly, the invention relates to an improvement in adaptive feedback cancellation.

2. Background

A common problem with hearing aids is oscillation caused by unstable feedback. Many investigators have described the use of adaptive feedback cancellation (AFC) to solve this problem. AFC may be performed either with a probe noise signal or with the normal hearing aid input. Hearing aid users generally find probe noise to be objectionable, so it is preferable to perform AFC with the normal hearing aid input signal. However, any correlation between the hearing aid input and output signals will introduce bias in the AFC adaptive filter coefficients, thus compromising performance. This problem is particularly severe for tonal input signals, such as music, which are highly autocorrelated.

The bias problem can be reduced by applying processing in the forward path of the hearing aid that decorrelates the output signal from the input signal. The decorrelation processing must be carefully designed to avoid introducing unpleasant auditory artifacts. One method of decorrelation is frequency shifting. In "Adaptive Feedback Cancellation with Frequency Compression for Hearing Aids", *Journal of the Acoustical Society of America,* 94(6):3248-3254 (1993), Joson et al. first proposed this method and showed it to be highly effective at reducing bias.

The method described by Joson et al. has the following features:

- The frequency shifting ratio is on the order of 6%.
- Frequencies are shifted downward ("frequency compression").
- Frequency shifting is accomplished using a "sampling method", in which the input signal is divided into short segments which are temporally stretched via interpolation and then concatenated with overlapping to produce the output signal.
- Interpolation of input segments is accomplished using standard sampling rate conversion techniques.
- Frequency shifting is applied to the entire signal, rather than to a band-limited portion of the signal.

This method may cause objectionable artifacts in four ways. First, any frequency shifting method alters the pitch perceived by the hearing aid user. A frequency shift of 6% corresponds to a musical half-step. For speech, this degree of pitch change may not be objectionable; indeed, Joson et al. found it to be "barely noticeable". However, music is a much more demanding test signal. Altering the pitch of music by a half-step is highly noticeable by listeners with musical experience.

A second artifact results from acoustic mixing of the processed and unprocessed signals. Because no hearing aid provides a perfectly attenuating seal, some unprocessed signal will leak past the hearing aid and acoustically mix with the processed signal inside the ear canal. Since the processed signal is a frequency-shifted version of the unprocessed signal, the resulting mix may have a distinctly unpleasant sound. For music, it would sound like two musicians playing out of tune with each other.

A third artifact results from the use of the "sampling method" of frequency shifting. This method is known to create artifacts at segment boundaries; additional processing, with consequent added complexity, is required to minimize these artifacts. Even with such additional processing, the method performs poorly for complex inputs such as music. Higher-quality methods of frequency shifting have been devised, particularly for music, but these methods are generally too computationally complex to be implemented under the power, size, and real-time constraints of a hearing aid.

A fourth artifact results from the introduction of a time-varying interaural timing difference (ITD). A frequency shifter, by its nature, is equivalent to a time-varying delay. If a hearing aid user is wearing a frequency-shifting hearing aid in one ear only, a time-varying ITD is created, because the signal received by the aided ear will be delayed, in a time-varying fashion, relative to the signal received by the unaided ear. The same phenomenon will occur if the hearing aid user is wearing frequency-shifting hearing aids in both ears, unless the two aids are synchronized to ensure that they impose exactly the same delay at all points in time. Such synchronization would require a means of communication between the two aids, which would significantly increase the complexity of implementation. The perceptual consequence of a time-varying ITD is the illusion of sound sources moving back and forth between the left and right sides of the user. This occurs because ITD is a strong perceptual cue for lateral position of sound sources.

SUMMARY OF THE INVENTION

The present invention is a modification of the frequency shifting method proposed by Joson et al. The modified method improves on the original method in order to reduce artifacts and improve computational and memory efficiency. The modifications may be summarized as follows:

- The frequency shifting ratio is on the order of 0.3%, 1/20 of the ratio used by Joson et al.
- Frequencies are shifted alternately upward and downward, with shift direction changing at regular intervals, rather than being shifted constantly downward.
- The input signal is processed as an unbroken data stream, rather than being divided into segments.
- Interpolation of input data is accomplished using a simple two-point linear interpolator, rather than a more complex interpolator designed for sampling rate conversion.
- Frequency shifting is applied only to the high-frequency portion of the signal.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
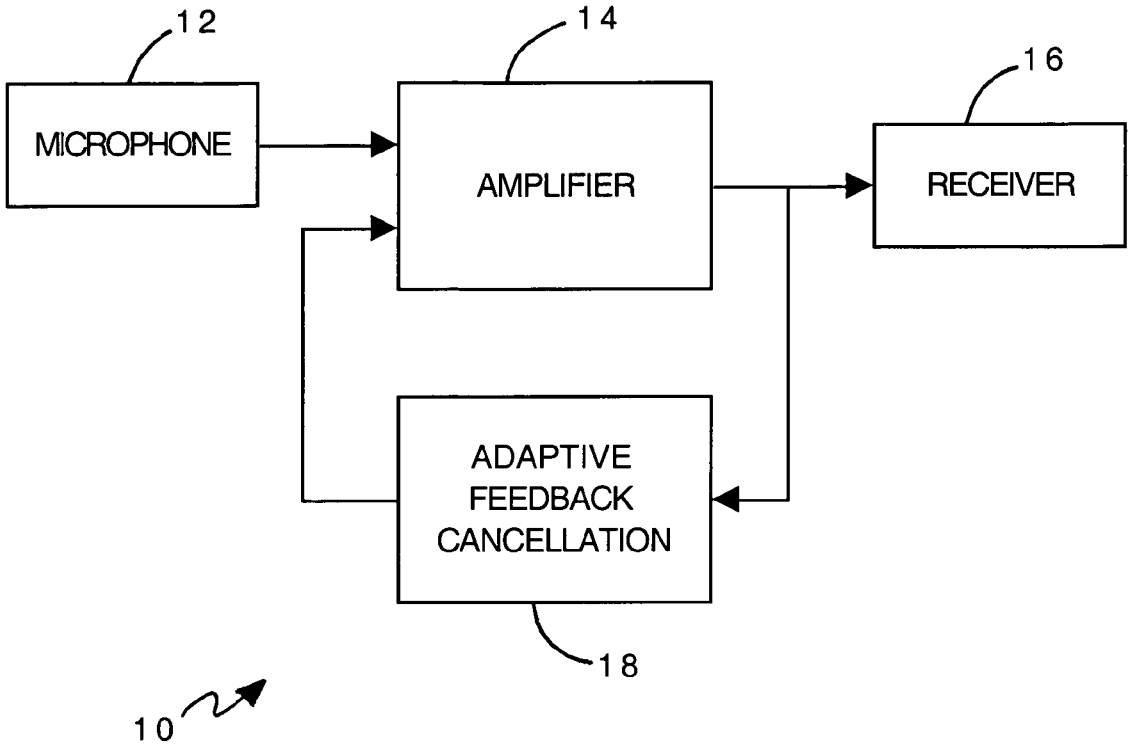
FIG. 1 is a block diagram of a hearing aid in which the present invention may be practiced.

FIG. 1 is a block diagram of a hearing aid 10 with which with the present invention may be practiced. Hearing aid 10 includes a microphone 12 for reception of ambient sound. The signal from microphone 12 is amplified by amplifier 14, which drives a miniature loudspeaker, or receiver, 16. The output signal of amplifier 14 is applied to adaptive feedback canceller 18, the output of which is fed back to amplifier 14.

Figure 2:
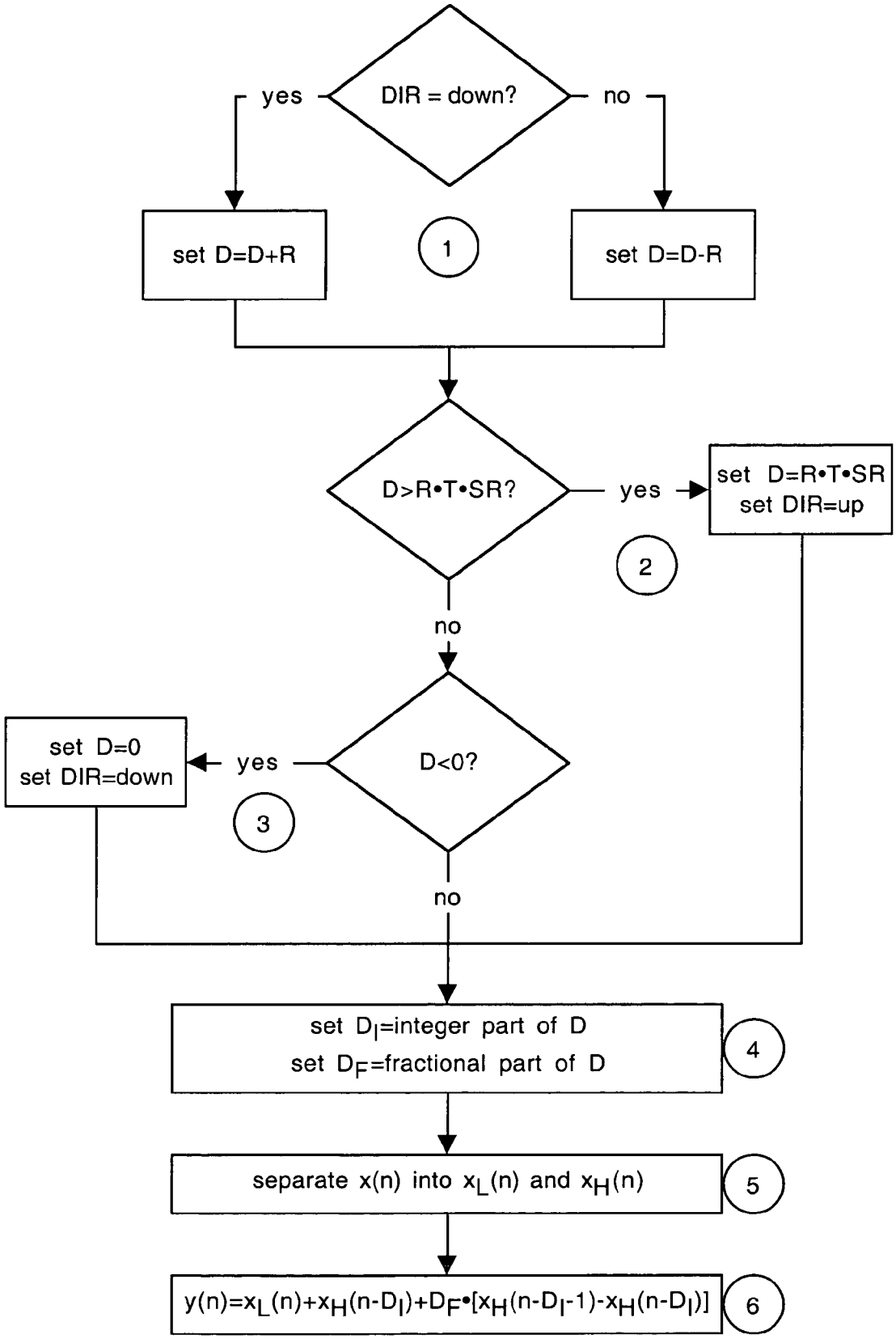
FIG. 2 is a functional flow diagram of the decorrelation processing of the present invention.

The decorrelation processing of the present invention is performed as follows (illustrated in FIG. 2):

Processing for Sample n

1. If DIR is "down", increment D by R. If DIR is "up", decrement D by R.
2. If $D>R\cdot T\cdot SR$, set $D=R\cdot T\cdot SR$ and set DIR="up".
3. If $D<0$, set $D=0$ and set DIR="down".
4. Set $D_I$=integer part of D and $D_F$=fractional part of D.
5. Separate x(n) into low- and high-frequency bands, $x_L(n)$ and $x_H(n)$.
6. Set $y(n)=x_L(n)+x_H(n-D_I)+D_F\cdot[x_H(n-D_I-1)-x_H(n-D_I)]$.

Symbols

R=frequency shifting ratio (typical value 0.003, or 0.3%)

T=time interval for switching direction, in seconds (typical value 0.5)

SR=sampling rate

D=current delay, in samples

DIR=current frequency shifting direction ("up" or "down")

x(n)=input signal, sample n y(n)=output signal, sample n

Initialization

D=0

DIR="down"

There are several benefits to the decorrelation method. First, the use of a much smaller frequency shifting ratio in comparison to the teachings of Joson et al. reduces the first two artifacts described above. The pitch change associated with a 0.3% frequency shift is 1/20 of a musical half-step, which is undetectable even for musical input signals. Likewise, acoustic mixing of processed and unprocessed signals that differ in frequency by 0.3% does not produce an "out of tune" percept. This small frequency difference does produce amplitude modulation ("beating"), but most input signals contain natural amplitude modulation that will mask this artifact.

An important indirect benefit of the small frequency shifting ratio is that it makes it feasible to alternate between upward and downward frequency shifting, rather than shifting in one direction only. Alternating direction creates the percept of alternating pitches. For larger frequency shifting ratios, the result would sound something like a European police siren, which would be highly objectionable. By contrast, alternating pitches that differ only by 1/10 of a musical half-step (i.e., ±1/20) is a subtle effect which is masked by the natural frequency modulation present in most input signals.

The benefit of alternating the direction of frequency shifting is that shifting can be accomplished without use of the "sampling method". Shifting frequencies downward requires temporal stretching of the input, while shifting upward requires temporal compression. If shifting is only performed in one direction, segmentation of the input signal is required. For example, for a constant downward shift without segmentation, the output delay relative to the input would constantly increase over time, eventually overflowing the memory buffer. Segmentation is required to allow the output to periodically "catch up" and to reset the buffer. The opposite problem occurs for a constant upward shift: the input falls behind the output until the memory buffer underflows, at which point segmentation is required. As discussed above, segmentation creates discontinuities at segment boundaries, with consequent artifacts. In the present invention, alternating shift direction allows the input/output delay to alternate between gradually increasing and decreasing. There is no need for segmentation, and thus no artifacts associated with segment boundaries.

Another benefit of the present invention results from replacing the complex interpolator with a simple two-point linear interpolator. Interpolators designed for sampling rate conversion typically require several multiplies and moderate amounts of memory. By contrast, a two-point linear interpolator requires only a single multiply and two words of memory. (Additional memory is required to accommodate the input/output delay, but this is required regardless of the choice of interpolation technique.) This type of interpolator is known to generate artifacts due to the time-varying degree of high-frequency attenuation as the interpolator progresses between adjacent buffer samples. However, the attenuation of these artifacts by the lowpass characteristic of typical hearing aid receivers renders the artifacts largely inaudible, and thus a two-point linear interpolator is feasible for hearing aid applications. The resulting decrease in computational and memory requirements is an important benefit, given the power, size, and real-time constraints of hearing aids.

A final benefit of the present invention results from limiting the action of the frequency shifter to the high-frequency portion of the signal. As discussed above, frequency shifting introduces a time-varying ITD, which creates the illusion of moving sound sources because ITD is a perceptual cue for lateral position of sound. However, the impact of ITD on perceived lateral position is strongest for low-frequency inputs and minimal for high-frequency inputs. Thus, the illusion of motion can be largely eliminated by dividing the input signal into low- and high-frequency bands, applying frequency shifting to the high band only, and then adding the bands back together. A reasonable cutoff frequency between the two bands is approximately 1 kHz. A variety of filtering methods may be used to accomplish the separation of the bands. One effective method is to create a lowpass/highpass pair of power complementary filters by taking the sum and difference of two allpass filters.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A decorrelation method for improving feedback cancellation comprising:

sampling an input signal;

separating the input signal into a low frequency component and a high frequency component;

shifting the high frequency component by an amount corresponding to a frequency shift of less than six percent, wherein the high frequency component is shifted alternately upward and downward in frequency;

computing an output signal corresponding to the sampled input signal as the sum of the low frequency component and shifted high frequency component.

2. The method of claim 1 wherein the high frequency component is shifted by an amount corresponding to a frequency shift of less than one percent.

3. The method of claim 1 wherein the high frequency component is shifted by an amount corresponding to a frequency shift of approximately 0.3 percent.

4. The method of claim 1 wherein the shift direction of the high frequency component is alternated at regular intervals.

5. A decorrelation method for improving feedback cancellation comprising:

sampling an input signal;

shifting at least one component of a predetermined number of samples of the input signal by an amount corresponding to a frequency shift in a first direction of less than six percent;

shifting said at least one component of a next predetermined number of samples of the input signal by an amount corresponding to a frequency shift in a second direction, opposite to the first direction, of less than six percent;

continuing to alternately shift said predetermined numbers of samples of the input signal;

computing an output signal corresponding to the sampled input signal as the sum of the at least one shifted component and unshifted components, if any.

6. The method of claim 5 wherein the at least one component is shifted by an amount corresponding to a frequency shift of less than one percent.

7. The method of claim 5 wherein the at least one component is shifted by an amount corresponding to a frequency shift of approximately 0.3 percent.

8. The method of claim 5 wherein the input signal is separated into a low frequency component and a high frequency component and wherein only the high frequency component is shifted.

* * * * *